US012590717B2

(12) United States Patent
Wang et al.

(10) Patent No.: US 12,590,717 B2
(45) Date of Patent: Mar. 31, 2026

(54) ELECTRIC CONTROL BOX OF AIR CONDITIONER AND AIR CONDITIONER

(71) Applicant: GD MIDEA AIR-CONDITIONING EQUIPMENT CO., LTD., Foshan (CN)

(72) Inventors: Xidong Wang, Foshan (CN); Bo Lv, Foshan (CN); Jing Ling, Foshan (CN); Qiankun Liu, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 133 days.

(21) Appl. No.: 18/687,406

(22) PCT Filed: Sep. 23, 2021

(86) PCT No.: PCT/CN2021/119952
§ 371 (c)(1),
(2) Date: Feb. 28, 2024

(87) PCT Pub. No.: WO2023/029124
PCT Pub. Date: Mar. 9, 2023

(65) Prior Publication Data

US 2024/0369237 A1 Nov. 7, 2024

(30) Foreign Application Priority Data

Aug. 31, 2021 (CN) ..... 202111016612.6
Aug. 31, 2021 (CN) ..... 202122086936.9

(51) Int. Cl.
*F24F 1/24* (2011.01)

(52) U.S. Cl.
CPC ..... *F24F 1/24* (2013.01)

(58) Field of Classification Search
CPC ... F24F 1/24; F24F 11/89; F24F 13/20; H05K 7/20
USPC ..... 165/80.4
See application file for complete search history.

(56) References Cited

U.S. PATENT DOCUMENTS

2015/0271949 A1 9/2015 Kim et al.

FOREIGN PATENT DOCUMENTS

| | | | |
|---|---|---|---|
| CN | 203132008 | U | 8/2013 |
| CN | 104613557 | A | 5/2015 |
| CN | 205825265 | U | 12/2016 |
| CN | 205842887 | U | 12/2016 |
| CN | 106455376 | A | 2/2017 |
| CN | 107366986 | A | 11/2017 |

(Continued)

OTHER PUBLICATIONS

The China National Intellectual Property Administration (CNIPA) The First Office Action for Chinese Application 202111016612.6 May 30, 2025 11 Pages (With Translation).

(Continued)

*Primary Examiner* — Steve S Tanenbaum
(74) *Attorney, Agent, or Firm* — Anova Law Group, PLLC

(57) ABSTRACT

An electric control box includes a heat dissipation device and a support base at which the heat dissipation device is mounted. A plurality of heat dissipation flow channels are formed at the support base and sequentially arranged in a height direction of the electric control box. Air outlets of at least two of the plurality of heat dissipation flow channels corresponding to the heat dissipation device.

17 Claims, 4 Drawing Sheets

(56) References Cited

FOREIGN PATENT DOCUMENTS

| | | | | |
|---|---|---|---|---|
| CN | 206831704 | U | | 1/2018 |
| CN | 207570038 | U | | 7/2018 |
| CN | 207831528 | U | | 9/2018 |
| CN | 208296128 | U | | 12/2018 |
| CN | 210951593 | U | | 7/2020 |
| CN | 215675453 | U | | 1/2022 |
| JP | H1151423 | A | | 2/1999 |
| JP | 2013133948 | A | * | 7/2013 |
| JP | 5811832 | B2 | | 11/2015 |

OTHER PUBLICATIONS

The European Patent Office (EPO) Extended Search Report for EP Application No. 21955654.5, Sep. 26, 2024 140 Pages.
The World Intellectual Property Organization (WIPO) International Search Report and Written Opinion for PCT/CN2021/119952 May 25, 2022 18 Pages (including translation).

* cited by examiner

ELECTRIC CONTROL BOX OF AIR CONDITIONER AND AIR CONDITIONER

CROSS-REFERENCE TO RELATED APPLICATIONS

This application is a National Stage Entry under 35 U.S.C. § 371 of International Application No. PCT/CN2021/119952, filed on Sep. 23, 2021, which claims priority to Chinese patent applications Nos. 202111016612.6 and 202122086936.9, filed by Guangdong Midea Air-Conditioning Equipment Co., Ltd. on Aug. 31, 2021, both titled "ELECTRIC CONTROL BOX OF AIR CONDITIONER AND AIR CONDITIONER," the entire contents of all of which are incorporated herein by reference.

FIELD

The present disclosure relates to the field of air conditioners, and more particularly, to an electric control box of an air conditioner and an air conditioner having the electric control box.

BACKGROUND

In the related art, an electric control box of an air conditioner is provided with a heat dissipation device therein. The heat dissipation device is configured to cool a component, such as a circuit board, a capacitor, a terminal, in the electric control box. However, heat dissipation of the heat dissipation device mainly relies on hot air passing through a condenser to realize cooling and heat dissipation. As a result, the heat dissipation device cannot reliably cool the component in the electric control box, resulting in a relatively short service life of the component in the electric control box. In addition, the component cannot be reduced in size, leading to a relatively high manufacturing cost of the component.

SUMMARY

The present disclosure aims to solve at least one of the technical problems in the related art. Embodiments of the present disclosure are to provide an electric control box of an air conditioner. The electric control box of the air conditioner can allow a heat dissipation device to reliably cool a component in the electric control box to keep a temperature of the component in the electric control box to be always within an appropriate operation temperature range, thereby prolonging a service life of the component. In addition, the component can be reduced in size to lower a manufacturing cost of the component.

Embodiments of the present disclosure further provide an air conditioner.

According to an embodiment of the present disclosure, an electric control box of an air conditioner includes a heat dissipation device and a support base at which the heat dissipation device is mounted. The support base aids to form a plurality of heat dissipation flow channels sequentially arranged in a height direction of the electric control box, and air outlets of at least two of the plurality of heat dissipation flow channels correspond to the heat dissipation device.

With the electric control box of the air conditioner according to the present disclosure, the plurality of heat dissipation flow channels are formed with the aids of the support base of the electric control box. When a fan blade of the air conditioner rotates, a high-speed negative pressure region is formed between the heat dissipation device and the fan blade, which may allow air within the air conditioner to flow through the heat dissipation device through the plurality of heat dissipation flow channels to cool and dissipate heat from the heat dissipation device. Therefore, the heat dissipation device can reliably cool the component in the electric control box to keep the temperature of the component in the electric control box to be always within the appropriate operation temperature range, thereby prolonging the service life of the component. In addition, the component can be reduced in size to lower the manufacturing cost of the component.

In some examples of the present disclosure, the plurality of heat dissipation flow channels include a first flow channel and a second flow channel. The first flow channel is located below the second flow channel.

In some examples of present disclosure, each of the first flow channel and the second flow channel extends obliquely upwards towards the heat dissipation device in a down-to-up direction of the electric control box.

In some examples of present disclosure, in a height direction of the first flow channel, a spacing between a lowest part of the first flow channel and an inner surface of the first flow channel opposite to the lowest part of the first flow channel is K1, and a height of the heat dissipation device is H, where $0.2H \leq K1$.

In some examples of present disclosure, the second flow channel is constructed as a variable cross-section flow channel. A minimum spacing between a lower surface of the second flow channel and an upper surface of the second flow channel in a height direction of the second flow channel is K2, where $0.2H \leq K2$.

In some examples of present disclosure, the support base includes a rain shield disposed at a side of the heat dissipation device. A spacing between the rain shield and the heat dissipation device is m, where $0.5\ (K1+K2) \leq m$.

In some examples of present disclosure, a main flow channel is formed with the aids of the support base. A partition is disposed in the main flow channel and divides the main flow channel into the first flow channel and the second flow channel.

In some examples of present disclosure, in the height direction of the electric control box, a projection of a lowest part of an upper surface of the second flow channel is located at a side of a projection of a lowest part of the partition close to the heat dissipation device.

In some examples of present disclosure, in the height direction of the electric control box, a highest part of the partition is located above a lowest part of an upper surface of the second flow channel.

In some examples of present disclosure, in the height direction of the electric control box, a spacing between a highest part of the partition and the heat dissipation device is Hn, and a height of the heat dissipation device is H, where $0.4H \leq Hn \leq 0.6H$.

In some examples of present disclosure, an air outlet and an air inlet are formed at two ends of the first flow channel in an extending direction of the first flow channel, respectively. A sectional area of the first flow channel gradually increases in a direction from the air inlet to the air outlet of the first flow channel.

In some examples of present disclosure, an air outlet and an air inlet are formed at two ends of the second flow channel in an extending direction of the second flow channel, respectively. A sectional area of the second flow channel gradually decreases and then gradually increases in a direction from the air inlet to the air outlet of the second flow channel.

According to the present disclosure, an air conditioner includes the above-mentioned electric control box of the air conditioner.

Additional aspects and advantages of the present disclosure will be provided at least in part in the following description, or will become apparent at least in part from the following description, or can be learned from practicing of the present disclosure.

DETAILED DESCRIPTION OF THE EMBODIMENTS

Figure 1:
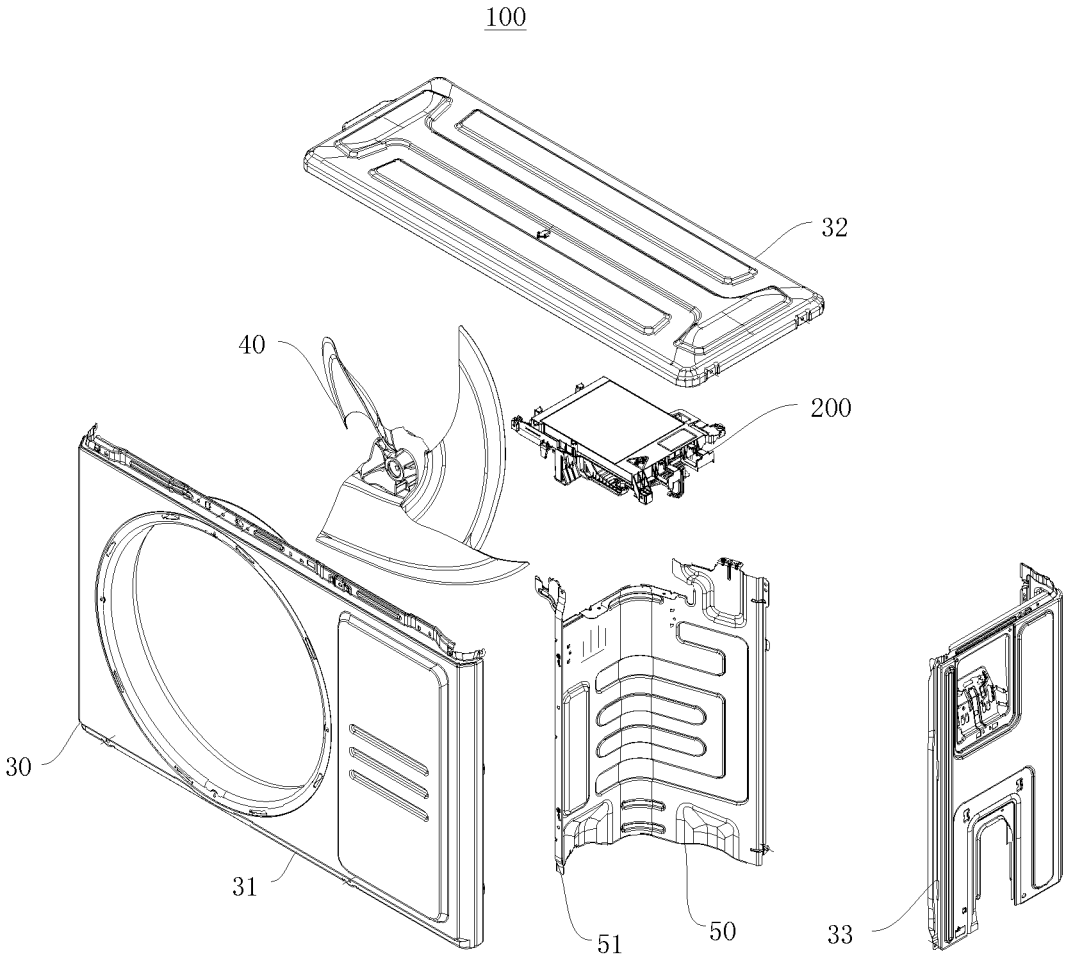
FIG. 1 is a schematic exploded view of an outdoor unit of an air conditioner according to an embodiment of the present disclosure.

Embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the drawings are illustrative only, and are intended to explain, rather than limit, the present disclosure.

An electric control box 200 of an air conditioner 100 according to an embodiment of the present disclosure will be described below with reference to FIG. 1 to FIG. 5.

As illustrated in FIG. 1 to FIG. 5, the electric control box 200 according to the embodiment of the present disclosure includes a heat dissipation device 10 and a support base 20.

The heat dissipation device 10 is disposed at the support base 20. The support base 20 may aid to form a plurality of heat dissipation flow channels 21 sequentially arranged in a height direction of the electric control box 200 (i.e., an up-down direction illustrated in FIG. 2). In addition, air outlets 27 of at least two of the plurality of heat dissipation flow channels 21 correspond to the heat dissipation device 10.

In another exemplary embodiment of the present disclosure, the electric control box 200 may be disposed at an outdoor unit of the air conditioner 100. In other embodiments of the present disclosure, the electric control box 200 may also be disposed at an indoor unit of the air conditioner 100. For an integrated air conditioner 100, the electric control box 200 may also be disposed in the integrated air conditioner 100. As an example, the present disclosure describes that the electric control box 200 is disposed at the outdoor unit of the air conditioner 100. However, the electric control box 200 of the present disclosure is not limited to being disposed in the outdoor unit of the air conditioner 100.

It should be understood that, as illustrated in FIG. 1, the outdoor unit of the air conditioner 100 may include an appearance sheet metal part 30, a fan blade 40, and a middle partition 50. The appearance sheet metal part 30 may include a front panel 31, a top cover 32, a left plate (not illustrated), a bottom panel (not illustrated), and a right plate 33. The appearance sheet metal part 30 may aid to form a mounting space. The electric control box 200, the fan blade 40, and the middle partition 50 may be disposed in the mounting space.

In another exemplary embodiment of the present disclosure, in a height direction of the air conditioner 100 (i.e., the up-down direction illustrated in FIG. 2), the middle partition 50 may be disposed below the electric control box 200. In addition, the fan blade 40 may be disposed at a side of the heat dissipation device 10. Air inlets 26 of the plurality of heat dissipation flow channels 21 formed with the aids of the support base 20 may be formed at another side of the heat dissipation device 10. For example, in a left-right direction illustrated in FIG. 2, the fan blade 40 may be disposed at a left side of the heat dissipation device 10. The air inlets 26 of the plurality of heat dissipation flow channels 21 formed with the aids of the support base 20 may be formed at a right side of the heat dissipation device 10.

A Component 60 may be provided within the electric control box 200. The component 60 may include components such as a circuit board 61, a terminal (not illustrated), and a capacitor (not illustrated). In another exemplary embodiment of the present disclosure, in the height direction of the air conditioner 100 (i.e., an up-down direction illustrated in FIG. 3), the circuit board 61 may be disposed above the heat dissipation device 10. In a left-right direction illustrated in FIG. 3, the component such as the terminal and the capacitor may be disposed at a side of the heat dissipation device 10 away from the fan blade 40 (i.e., the component such as the terminal and the capacitor may be disposed at the right side of the heat dissipation device 10). The heat dissipation device 10 is configured to dissipate heat from the component 60 in the electric control box 200.

In the related art, through-air-type heat dissipation of the heat dissipation device mainly relies on hot air passing through a condenser for cooling and heat dissipation. As a result, the heat dissipation device cannot reliably cool the component in the electric control box, resulting in a relatively short service life of the component in the electric control box. In addition, the component cannot be reduced in size, leading to a relatively high manufacturing cost of the component.

Figure 2:
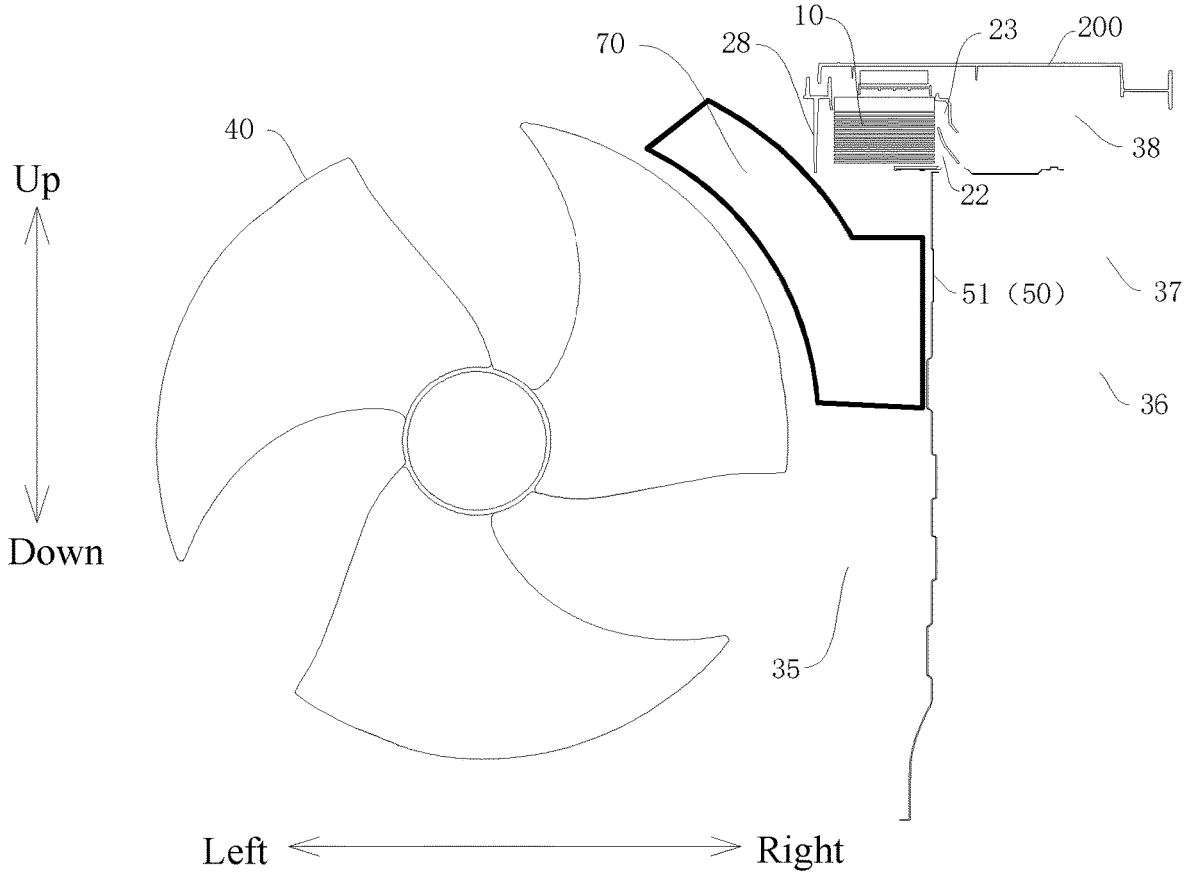
FIG. 2 is a schematic sectional view of an electric control box, a fan blade, and a middle partition according to an embodiment of the present disclosure.

In the present disclosure, however, it should be understood that, as illustrated in FIG. 2, when the fan blade 40 rotates at a high speed, a high-speed negative pressure region 70 is formed between the fan blade 40 and the heat dissipation device 10 based on Bernoulli's principle. Under a traction of the high-speed negative pressure region 70, air at the side of the heat dissipation device 10 away from the fan blade 40 flows towards the high-speed negative pressure region 70. With the plurality of heat dissipation flow channels 21 formed with the aids of the support base 20, the air at the side of the heat dissipation device 10 away from the fan blade 40 flows through the heat dissipation device 10 through the plurality of heat dissipation flow channels 21 to cool and dissipate heat from the heat dissipation device 10, thereby realizing rapid cooling and heat dissipation for the heat dissipation device 10. In this way, the heat dissipation device 10 can reliably cool the component 60 in the electric control box 200, thereby prolonging the service life of the component 60. In addition, since the heat dissipation device 10 can reliably cool the component 60 in the electric control box 200, a heat dissipation demand can be satisfied without increasing the size of the component 60. Therefore, the size of the component 60 can be reduced, which contributes to lowering the manufacturing cost of the component 60.

Therefore, by forming the plurality of heat dissipation flow channels 21 with the aids of the support base 20 of the electric control box 200, when the fan blade 40 of the air conditioner 100 rotates, the high-speed negative pressure region 70 is formed between the heat dissipation device 10 and the fan blade 40, to allow air in the air conditioner 100 to flow through the heat dissipation device 10 through the plurality of heat dissipation flow channels 21 to cool and dissipate heat from the heat dissipation device 10. Therefore, the heat dissipation device 10 can reliably cool the component 60 in the electric control box 200 to keep a temperature of the component 60 in the electric control box 200 to be always within an appropriate operation temperature range, thereby prolonging the service life of the component 60. In addition, the size of the component 60 can be reduced to lower the manufacturing cost of the component 60.

In some embodiments of the present disclosure, as illustrated in FIG. 2 to FIG. 5, the plurality of heat dissipation flow channels 21 may include a first flow channel 22 and a second flow channel 23. In the height direction of the air conditioner 100 (i.e., the up-down direction illustrated in FIG. 3), the first flow channel 22 may be located below the second flow channel 23. In addition, an air outlet 27 of the first flow channel 22 and an air outlet 27 of the second flow channel 23 may be formed at positions corresponding to the heat dissipation device 10.

Figure 3:
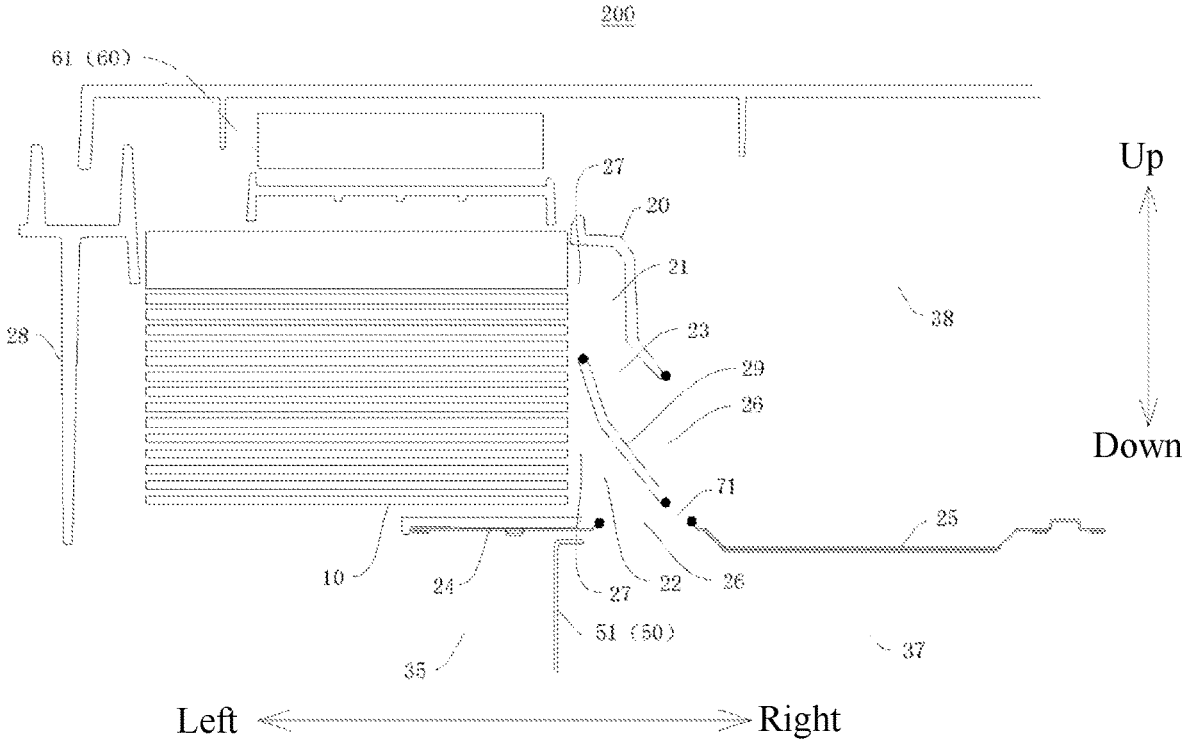
FIG. 3 is a schematic sectional view of an electric control box and a middle partition according to an embodiment of the present disclosure.

In another exemplary embodiment of the present disclosure, as illustrated in FIG. 3, the support base 20 may include a first support plate 24 and a second support plate 25. In the height direction of the air conditioner 100 (i.e., the up-down direction illustrated in FIG. 3), the first support plate 24 may be located below the heat dissipation device 10. The first support plate 24 is be configured to support and seal the heat dissipation device 10. The second support plate 25 may be located at the side of the heat dissipation device 10 away from the fan blade 40. In an exemplary embodiment of the present disclosure, in the left-right direction illustrated in FIG. 3, the second support plate 25 may be located at the right side of the heat dissipation device 10. The component such as the terminal and the capacitor may be disposed above the second support plate 25, and the second support plate 25 can protect the component such as the terminal and the capacitor disposed above the second support plate 25.

In another exemplary embodiment of the present disclosure, the support base 20 may be an integrated piece, or the support base 20 may be formed by connecting a plurality of parts through welding, engagement, or screwing. The present disclosure is not limited in this regard.

As illustrated in FIG. 1, the middle partition 50 may include a first partition 51. The first partition 51 can divide the mounting space into an air duct cavity 35 and a compressor cavity 36. In an exemplary embodiment of the present disclosure, in the left-right direction illustrated in FIG. 2, the air duct cavity 35 may be formed at a left side of the middle partition 50, and the compressor cavity 36 may be formed at a right side of the middle partition 50. The fan blade 40 may be disposed in the air duct cavity 35. A compressor of the air conditioner 100 may be disposed in the compressor cavity 36. Further, the compressor cavity 36 may be divided into a compressor side 37 and an electric control side 38 by the support base 20. In the height direction of the air conditioner 100, the compressor side 37 may be located below the electric control side 38. An air inlet 26 of the first flow channel 22 may be in communication with the compressor side 37, and an air inlet 26 of the second flow channel 23 may be in communication with the electric control side 38.

When the fan blade 40 rotates at a high speed, the high-speed negative pressure region 70 is formed between the fan blade 40 and the heat dissipation device 10 based on Bernoulli's principle. Under the traction of the high-speed negative pressure region 70, air in the compressor side 37 may flow into the first flow channel 22 through the air inlet 26 of the first flow channel 22, to allow first-stage cooling and heat dissipation of the heat dissipation device 10 to be carried out by means of the air to flow through the heat dissipation device 10. In addition, under the traction of the high-speed negative pressure region 70, air in the electric control side 38 may flow into the second flow channel 23 through the air inlet 26 of the second flow channel 23, to allow second-stage cooling and heat dissipation of the heat dissipation device 10 to be carried out by means of the air to flow through the heat dissipation device 10.

It should be understood that the first-stage cooling and heat dissipation of the heat dissipation device 10 is mainly to dissipate heat from a lower part of the heat dissipation device 10, and the second-stage cooling and heat dissipation of the heat dissipation device 10 is mainly to dissipate heat from an upper part of the heat dissipation device 10.

Therefore, multi-stage cooling and heat dissipation of the heat dissipation device 10 can be carried out, thereby realizing rapid cooling and heat dissipation for the heat dissipation device 10. In this way, the heat dissipation device 10 can reliably cool the component 60 in the electric control box 200. In addition, by forming the first flow channel 22 below the second flow channel 23, it is possible to prevent air in the first flow channel 22 and air in the second flow channel 23 from interfering with each other, allowing the air to rapidly pass through the first flow channel 22 and the second flow channel 23 to cool and dissipate heat from the heat dissipation device 10.

It should be understood that when flowing into the second flow channel 23 through the air inlet 26 of the second flow channel 23, the air in the electric control side 38 can cool and dissipate heat from the components disposed above the second support plate 25 such as the terminal and the capacitor. Then, the air in the electric control side 38 can flow through the heat dissipation device 10 to allow for the second-stage cooling and heat dissipation of the heat dissipation device 10. In this way, temperatures of the components such as the terminal and the capacitor disposed above the second support plate 25 can be prevented from being too high, thereby ensuring use reliability and prolonging service lives of the components such as the terminal and the capacitor.

It should be emphasized that cooling and heat dissipation of the heat dissipation device 10 of the present disclosure can be carried out by means of the hot air passing through the condenser. In other words, the cooling and heat dissipation of the heat dissipation device 10 of the present disclosure can be carried out by means of the hot air passing through the condenser and by means of the air at the side of the heat dissipation device 10 away from the fan blade 40 flowing towards the high-speed negative pressure region 70 under the traction of the high-speed negative pressure region 70. Therefore, rapid cooling and heat dissipation for the heat dissipation device 10 can be realized.

Figure 4:
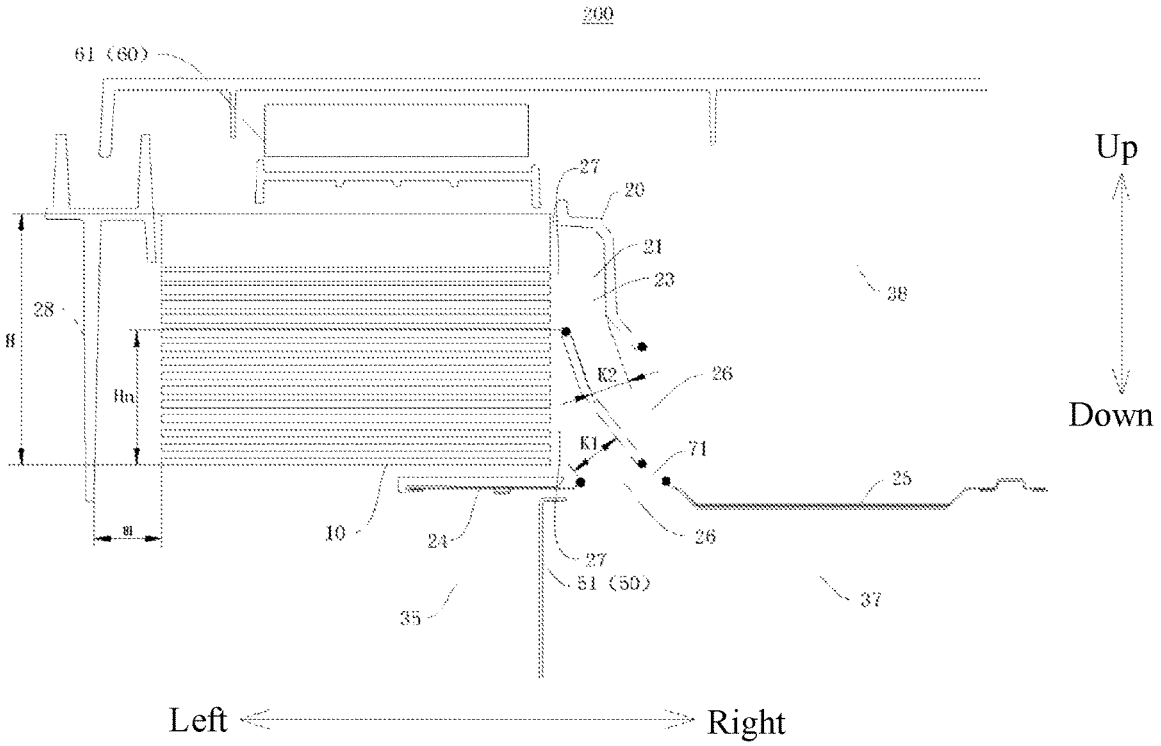
FIG. 4 is another schematic sectional view of an electric control box and a middle partition according to an embodiment of the present disclosure.

As some embodiments of the present disclosure, as illustrated in FIG. 2 to FIG. 4, in the left-right direction illustrated in FIG. 3, the first partition 51 may be located at a left side of the air inlet 26 of the first flow channel 22. Further, the first partition 51 may be located at a left side of a plurality of air inlets 26 of the plurality of heat dissipation flow channels 21. With this arrangement, the air duct cavity 35 can be separated from the first flow channel 22 and the second flow channel 23 to form convection between the air duct cavity 35 and the first flow channel 22 and the second flow channel 23. Therefore, a flow rate of air can be increased, which facilitates the cooling and heat dissipation for the heat dissipation device 10.

In some embodiments of the present disclosure, as illustrated in FIG. 2 to FIG. 4, in the height direction of the electric control box 200, both the first flow channel 22 and the second flow channel 23 may extend obliquely upwards towards the heat dissipation device 10 in a down-to-up direction illustrated in FIG. 3. Such an arrangement facilitates an increase in an air inflowing volume of the first flow channel 22 and an air inflowing volume of the second flow channel 23, which can realize a relatively high air inflowing volume of each of the first flow channel 22 and the second flow channel 23. Therefore, a great volume of air can be ensured to pass through the heat dissipation device 10. Therefore, it is possible to avoid a situation where the heat dissipation device 10 is overheated and cannot cool down the component 60 in the electric control box 200.

In some embodiments of the present disclosure, as illustrated in FIG. 4, in a height direction of the first flow channel 22 (i.e., an up-down direction illustrated in FIG. 4), a spacing between a lowest part of the first flow channel 22 and an inner surface of the first flow channel 22 opposite to the lowest part of the first flow channel 22 may be K1, and a height of the heat dissipation device 10 may be H where 0.2H≤K1. That is, the spacing between the lowest part of the first flow channel 22 and the inner surface of the first flow channel 22 opposite to the lowest part of the first flow channel 22 may be greater than or equal to 0.2 times the height of the heat dissipation device 10. The spacing between the lowest part of the first flow channel 22 and the inner surface of the first flow channel 22 opposite to the lowest part of the first flow channel 22 may be understood as a minimum vertical distance of the first flow channel 22.

It should be understood that if K1 is too small, a throttling phenomenon occurs in the first flow channel 22, reducing a flowing efficiency of the air in the first flow channel 22, thereby affecting the air inflowing volume of the first flow channel 22. By setting K1 and H to satisfy a relationship of 0.2H≤K1, K1 can have a reasonable value range to avoid the throttling phenomenon in the first flow channel 22, which is conducive to improving the flowing efficiency of the air in the first flow channel 22, thereby allowing the first flow channel 22 to have a relatively high air inflowing volume. In other embodiments of the present disclosure, K1 is also limited by an actual structural space. In other words, K1 cannot be infinitely enlarged.

In some embodiments of the present disclosure, as illustrated in FIG. 4, the second flow channel 23 may be constructed as a variable cross-section flow channel. In addition, a minimum spacing between a lower surface and an upper surface of the second flow channel 23 in a height direction of the second flow channel 23 (i.e., the up-down direction illustrated in FIG. 4) may be K2, and the height of the heat dissipation device 10 may be H, where 0.2H≤K2. That is, the minimum spacing between the lower surface and the upper surface of the second flow channel 23 can be greater than or equal to 0.2 times the height of the heat dissipation device 10. The minimum spacing between the lower surface and the upper surface of the second flow channel 23 can be understood as a minimum vertical distance of the second flow channel 23.

It should be understood that if K2 is too small, a throttling phenomenon occurs in the second flow channel 23, reducing flowing efficiency of the air in the second flow channel 23, thereby affecting the air inflowing volume of the second flow channel 23. By setting K2 and H to satisfy a relationship of 0.2H≤K2, K2 can have a reasonable value range to avoid the throttling phenomenon in the second flow channel 23, which is conducive to improving the flowing efficiency of the air in the first flow channel 22, thereby allowing the second flow channel 23 to have a relatively high air inflowing volume. In other embodiments of the present disclosure, K2 is also limited by an actual structural space. In other words, K2 cannot be infinitely enlarged. In addition, constructing the second flow channel 23 as the variable cross-section flow channel can avoid local air backflow and improve air circulation efficiency.

Further, by constructing K1 and H in the form satisfying the relationship of 0.2H≤K1, and by constructing K2 and H in the form satisfying the relationship of 0.2H≤K2, the air inflowing volumes of the first flow channel 22 and the second flow channel 23 can be ensured to satisfy a heat dissipation demand of the heat dissipation device 10 under an operation condition of minimum throttling.

In some embodiments of the present disclosure, as illustrated in FIG. 2 to FIG. 5, the support base 20 may include a rain shield 28. The rain shield 28 may be disposed at a side of the heat dissipation device 10. In an exemplary embodiment of the present disclosure, in a left-right direction illustrated in FIG. 4, the rain shield 28 may be disposed at the left side of the heat dissipation device 10. A spacing between the rain shield 28 and the heat dissipation device 10 may be denoted as m, and m, K1, and K2 may satisfy a relationship of 0.5 (K1+K2)≤m.

It should be understood that the rain shield 28 is configured to block a liquid (e.g. rainwater) to prevent the liquid from entering an interior of the electric control box 200. By arranging the rain shield 28, a risk of the liquid flowing into the interior of the electric control box 200 can be reduced, which is conducive to ensuring use safety of the component 60 in the electric control box 200.

In addition, it should be noted that with an increase in the spacing between the rain shield 28 and the heat dissipation device 10, a heat dissipation and cooling effect for the heat dissipation device 10 becomes better. In addition, if a value of m is too small compared with a value of K1 and a value of K2, a pressure imbalance occurs at the air inlet 26 and the air outlet 27 of each of the first flow channel 22 and the second flow channel 23, affecting the air inflowing volumes of the first flow channel 22 and the second flow channel 23, which in turn affects the flowing efficiency of the air in each of the first flow channel 22 and the second flow channel 23.

Therefore, by setting m, K1, and K2 to satisfy the relationship of 0.5 (K1+K2)≤m, m, K1, and K2 can have reasonable values to avoid the pressure imbalance at the air inlet 26 and the air outlet 27 of each of the first flow channel 22 and the second flow channel 23. In this way, the first flow channel 22 and the second flow channel 23 have relatively high air inflowing volumes, thereby realizing a relatively high flowing efficiency of the air in each of the first flow channel 22 and the second flow channel 23. Therefore, the heat dissipation demand of the heat dissipation device 10 can be satisfied.

Figure 5:
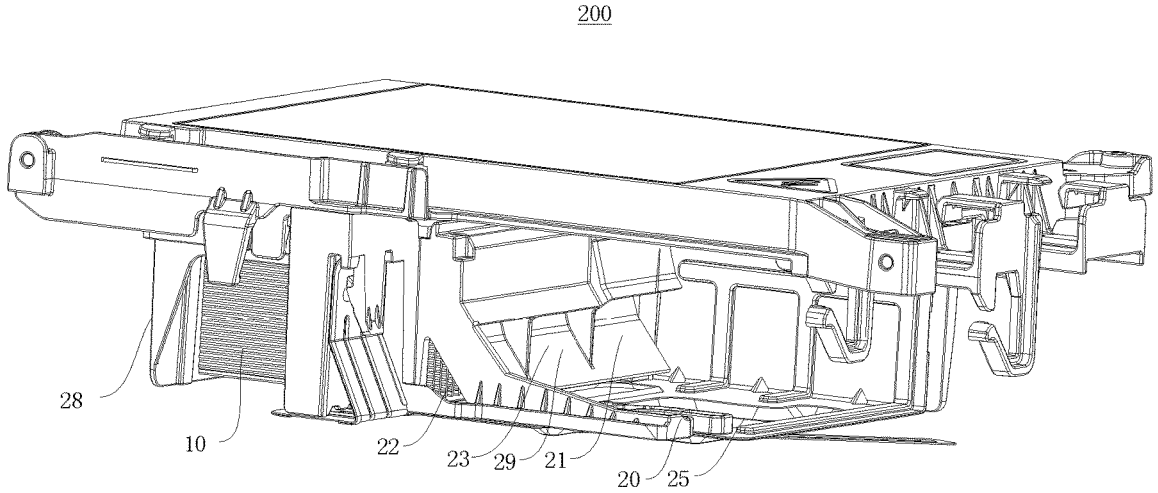
FIG. 5 is a schematic view of an electric control box according to an embodiment of the present disclosure.

In some embodiments of the present disclosure, as illustrated in FIG. 3 to FIG. 5, a main flow channel may be formed with the aids of the support base 20. A partition 29 may be disposed in the main flow channel. The partition 29 may divide the main flow channel into the first flow channel 22 and the second flow channel 23. In this way, the first flow channel 22 and the second flow channel 23 can be formed. In addition, it can be appreciated that the air inlet 26 of the first flow channel 22 may be formed by a first end of the first support plate 24 (i.e., a right end of the first support plate 24 in the left-right direction illustrated in FIG. 3) and the partition 29 together. In another exemplary embodiment of the present disclosure, the first partition 51 may be located at a left side of the first end of the first support plate 24. With this arrangement, the air duct cavity 35 can be separated from the first flow channel 22 and the second flow channel 23 to form the convection between the air duct cavity 35 and the first flow channel 22 and the second flow channel 23. Therefore, the flow rate of the air can be increased, which facilitates the cooling and heat dissipation for the heat dissipation device 10.

It should be understood that a vertical distance between the first end of the first support plate 24 and the partition 29 is the spacing between the lowest part of the first flow channel 22 and the inner surface of the first flow channel 22 opposite to the lowest part of the first flow channel 22.

In some embodiments of the present disclosure, as illustrated in FIG. 3, in the height direction of the electric control box 200 (i.e., the up-down direction illustrated in FIG. 3), a projection of a lowest part of the upper surface of the second flow channel 23 may be located at a side of a projection of a lowest part of the partition 29 close to the heat dissipation device 10. In other words, the projection of the lowest part of the upper surface of the second flow channel 23 may be located at a left side of the projection of the lowest part of the partition 29.

It should be noted that a gap 719 is formed between the partition 29 and the second support plate 25. When the liquid (such as rainwater) splashes towards the heat dissipation device 10 from a right side of the heat dissipation device 10, the liquid merges at an outer wall surface of the second flow channel 23. Further, under an action of gravity, the liquid drops to a surface of the partition 29 from the outer wall surface of the second flow channel 23. The liquid dropped onto the surface of the partition 29 may drop between the partition 29 and the second support plate 25 under the action of gravity. Since the gap 71 is formed between the partition 29 and the second support plate 25, the liquid dropped from the surface of the partition 29 can leave the electric control box 200 through the gap 71. In this way, the risk of the liquid flowing into the interior of the electric control box 200 can be further reduced, which is conducive to ensuring the use safety of the component 60 in the electric control box 200.

In some embodiments of the present disclosure, as illustrated in FIG. 3, in the height direction of the electric control box 200 (i.e., the up-down direction illustrated in FIG. 3), a highest part of the partition 29 may be located above a lowest part of an upper surface of the second flow channel 23. In this way, water mist can be prevented from flowing onto the circuit board 61 through the second flow channel 23, which can prevent the circuit board 61 from malfunctioning due to the water mist. Therefore, the electric control box 200 has satisfactory waterproof performance.

In some embodiments of the present disclosure, as illustrated in FIG. 4, in the height direction of the electric control box 200 (i.e., the up-down direction illustrated in FIG. 4), a spacing between a highest part of the partition 29 and the heat dissipation device 10 may be Hn, and a height of the heat dissipation device may be H, where $0.4H \leq Hn \leq 0.6H$. That is, the spacing between the highest part of the partition 29 and the heat dissipation device 10 may be greater than or equal to 0.4 times the height of the heat dissipation device 10. In addition, the spacing between the highest part of the partition 29 and the heat dissipation device 10 may also be smaller than or equal to 0.6 times the height of the heat dissipation device 10.

It should be understood that the spacing between the highest part of the partition 29 and the heat dissipation device 10 represents a flow distribution between the first flow channel 22 and the second flow channel 23. Too large or too small the spacing between the highest part of the partition 29 and the heat dissipation device 10 results in too low air inflowing volume of the first flow channel 22 or of the second flow channel 23.

For example, if the spacing between the highest part of the partition 29 and the heat dissipation device 10 is too small, the air inflowing volume of the first flow channel 22 is too low, resulting in unsatisfactory first-stage cooling and heat dissipation for the heat dissipation device 10 (i.e., unsatisfactory cooling and heat dissipation for the lower part of the heat dissipation device 10). If the spacing between the highest part of the partition 29 and the heat dissipation device 10 is too large, the air inflowing volume of the second flow channel 23 is too low, resulting in unsatisfactory second-stage cooling and heat dissipation for the heat dissipation device 10 (i.e., unsatisfactory cooling and heat dissipation for the upper part of the heat dissipation device 10).

By setting Hn and H to satisfy the relationship of $0.4H \leq Hn \leq 0.6H$, Hn may have a reasonable value range, and thus the flow distribution between the first flow channel 22 and the second flow channel 23 is reasonable. In this way, satisfactory cooling and heat dissipation can be realized for both the lower part and the upper part of the heat dissipation device 10.

In some embodiments of the present disclosure, as illustrated in FIG. 3 and FIG. 4, in an extending direction of the first flow channel 22, an air outlet 27 and an air inlet 26 may be formed at two ends of the first flow channel 22, respectively. A sectional area of the first flow channel 22 may gradually increase in a direction from the air inlet 26 to the air outlet 27 of the first flow channel 22.

It should be explained that, in the direction from the air inlet 26 of the first flow channel 22 to the air outlet 27 of the first flow channel 22, by setting the sectional area of the first flow channel 22 to gradually increase, the air inflowing volume of the first flow channel 22 can be increased. Thus, a relatively large amount of air can pass through the lower part of the heat dissipation device 10, thereby realizing effective cooling and heat dissipation for the lower half of the heat dissipation device 10.

In some embodiments of the present disclosure, as illustrated in FIG. 3 and FIG. 4, in an extending direction of the second flow channel 23, an air outlet 27 and an air inlet 26 may be formed at two ends of the second flow channel 23, respectively. A sectional area of the second flow channel 23 may gradually decrease and then gradually increase in a direction from the air inlet 26 to the air outlet 27 of the second flow channel 23.

It should be explained that, in the direction from the air inlet 26 to the air outlet 27 of the second flow channel 23, the sectional area of the second flow channel 23 is set to gradually decrease and then gradually increase. Based on the Bernoulli's equation (i.e., the sum of a static pressure and dynamic pressure is constant), when air flows into the second flow channel 23 from the air inlet 26 of the second flow channel 23, the air is subjected to two stages. In the first stage, since the sectional area of the second flow channel 23 gradually decreases, the flow rate of the air increases (in which case the dynamic pressure of the air increases and the static pressure of the air decreases), to allow a relatively large amount of air to flow into the second flow channel 23.

In the second stage, since the sectional area of the second flow channel 23 gradually increases, the flow rate of the air decreases. In addition, the static pressure of the air increases. The increased static pressure can avoid local air backflow and improve an air circulation efficiency. Therefore, a sufficient heat exchange between the air and the upper half of the heat dissipation device 10 can be implemented to realize effective cooling and heat dissipation for the upper part of the heat dissipation device 10.

The air conditioner 100 according to the embodiments of the present disclosure includes the electric control box 200 of the air conditioner 100 as described in the above-mentioned embodiments. The plurality of heat dissipation flow channels 21 are formed with the aids of the support base 20 of the electric control box 200. When the fan blade 40 of the air conditioner 100 rotates, the high-speed negative pressure region 70 is formed between the heat dissipation device 10 and the fan blade 40, to allow air in the air conditioner 100 to flow through the heat dissipation device 10 through the plurality of heat dissipation flow channels 21 to cool and dissipate heat from the heat dissipation device 10. Therefore, the heat dissipation device 10 can reliably cool the component 60 in the electric control box 200 to keep a temperature of the component 60 in the electric control box 200 to be always within an appropriate operation temperature range, thereby prolonging the service life of the component 60. In addition, the size of the component 60 can be reduced to lower the manufacturing cost of the component 60.

In the description of the present disclosure, it should be understood that, the orientation or the position indicated by terms such as "center," "longitudinal," "lateral," "length," "width," "thickness," "over," "below," "front," "rear," "left," "right," "vertical," "horizontal," "top," "bottom," "inner," "outer," "clockwise," "anti-clockwise," "axial," "radial," and "circumferential" should be construed to refer to the orientation and the position as shown in the drawings, and is only for the convenience of describing the present disclosure and simplifying the description, rather than indicating or implying that the pointed device or element must have a specific orientation, or be constructed and operated in a specific orientation, and therefore cannot be understood as a limitation of the present disclosure.

In the description of the present disclosure, "first feature" and "second feature" may include one or more of these features.

In the description of the present disclosure, "plurality" means two or more.

In the description of the present disclosure, the first feature "on" or "under" the second feature may mean that the first feature is in direct contact with the second feature, or the first and second features are in indirect contact through another feature between them.

In the description of the present disclosure, the first feature "above" the second feature means that the first feature is directly above or obliquely above the second feature, or simply means that the level of the first feature is higher than that of the second feature.

Throughout this specification, description with reference to "an embodiment," "some embodiments," "an illustrative embodiment," "an example," "a specific example," "some examples," or the like means that a particular feature, structure, material, or characteristic described in connection with the embodiment or example is included in at least one embodiment or example of the present disclosure. The appearances of the above phrases in various places throughout this specification are not necessarily referring to the same embodiment or example of the present disclosure. Further, the particular features, structures, materials, or characteristics described here may be combined in any suitable manner in one or more embodiments or examples.

Although embodiments of the present disclosure have been illustrated and described, it is conceivable for those skilled in the art that various changes, modifications, replacements, and variations may be made to these embodiments without departing from the principles and spirit of the present disclosure. The scope of the present disclosure shall be defined by the claims as appended and their equivalents.

What is claimed is:

1. An electric control box comprising:

a heat dissipation device; and a support base at which the heat dissipation device is mounted, a plurality of heat dissipation flow channels being formed at the support base and sequentially arranged in a height direction of the electric control box, and air outlets of at least two of the plurality of heat dissipation flow channels corresponding to the heat dissipation device;

wherein:

the plurality of heat dissipation flow channels include a first flow channel and a second flow channel, the first flow channel being located below the second flow channel in the height direction; and a main flow channel is formed at the support base, a partition being disposed in the main flow channel and dividing the main flow channel into the first flow channel and the second flow channel.

2. The electric control box according to claim 1, wherein, in a down-to-up direction of the electric control box, each of the first flow channel and the second flow channel extends along a direction towards the heat dissipation device, the direction being oblique relative a vertical direction.

3. The electric control box according to claim 1, wherein in a height direction of the first flow channel, a spacing K1 between a lowest part of the first flow channel and an inner surface of the first flow channel opposite to the lowest part of the first flow channel and a height H of the heat dissipation device satisfy $0.2H \leq K1$.

4. The electric control box according to claim 1, wherein:

the second flow channel is constructed as a variable cross-section flow channel; and a minimum spacing K2 between a lower surface and an upper surface of the second flow channel in a height direction of the second flow channel and the height H satisfy $0.2H \leq K2$.

5. The electric control box according to claim 1, wherein:

the support base includes a rain shield disposed at a side of the heat dissipation device; and a spacing m between the rain shield and the heat dissipation device, a spacing K1 between a lowest part of the first flow channel and an inner surface of the first flow channel opposite to the lowest part of the first flow channel, and a minimum spacing K2 between a lower surface and an upper surface of the second flow channel in a height direction of the second flow channel satisfy $0.5(K1+K2) \leq m$.

6. The electric control box according to claim 1, wherein in the height direction of the electric control box, a projection of a lowest part of an upper surface of the second flow channel is located at a side of a projection of a lowest part of the partition close to the heat dissipation device.

7. The electric control box according to claim 1, wherein in the height direction of the electric control box, a highest part of the partition is located above a lowest part of an upper surface of the second flow channel.

8. The electric control box according to claim 1, wherein in the height direction of the electric control box, a spacing Hn between a highest part of the partition and the heat dissipation device and a height H of the heat dissipation device satisfy $0.4H \leq Hn \leq 0.6H$.

9. The electric control box according to claim 1, wherein an air outlet and an air inlet are formed at two ends, respectively, of the first flow channel in an extending direction of the first flow channel, a sectional area of the first flow channel gradually increasing in a direction from the air inlet to the air outlet of the first flow channel.

10. The electric control box according to claim 1, wherein an air outlet and an air inlet are formed at two ends, respectively, of the second flow channel in an extending direction of the second flow channel, a sectional area of the second flow channel gradually decreasing and then gradually increasing in a direction from the air inlet to the air outlet of the second flow channel.

11. An air conditioner comprising:

an electric control box including:

a heat dissipation device; and a support base at which the heat dissipation device is mounted, a plurality of heat dissipation flow channels being formed at the support base and sequentially arranged in a height direction of the electric control box, and air outlets of at least two of the plurality of heat dissipation flow channels corresponding to the heat dissipation device;

wherein:

the plurality of heat dissipation flow channels include a first flow channel and a second flow channel, the first flow channel being located below the second flow channel in the height direction; and a main flow channel is formed at the support base, a partition being disposed in the main flow channel and dividing the main flow channel into the first flow channel and the second flow channel.

12. The air conditioner according to claim 11, wherein, in a down-to-up direction of the electric control box, each of the first flow channel and the second flow channel extends along a direction towards the heat dissipation device, the direction being oblique relative a vertical direction.

13. The air conditioner according to claim 11, wherein in a height direction of the first flow channel, a spacing K1 between a lowest part of the first flow channel and an inner surface of the first flow channel opposite to the lowest part of the first flow channel and a height H of the heat dissipation device satisfy $0.2H \leq K1$.

14. The air conditioner according to claim 11, wherein:

the second flow channel is constructed as a variable cross-section flow channel; and a minimum spacing K2 between a lower surface and an upper surface of the second flow channel in a height direction of the second flow channel and the height H satisfy $0.2H < K2$.

15. The air conditioner according to claim 11, wherein:

the support base includes a rain shield disposed at a side of the heat dissipation device; and a spacing m between the rain shield and the heat dissipation device, a spacing K1 between a lowest part of the first flow channel and an inner surface of the first flow channel opposite to the lowest part of the first flow channel, and a minimum spacing K2 between a lower surface and an upper surface of the second flow channel in a height direction of the second flow channel satisfy $0.5(K1+K2) \leq m$.

16. The air conditioner according to claim 11, wherein in the height direction of the electric control box, a projection of a lowest part of an upper surface of the second flow channel is located at a side of a projection of a lowest part of the partition close to the heat dissipation device.

17. An electric control box comprising:

a heat dissipation device; and a support base at which the heat dissipation device is mounted, a plurality of heat dissipation flow channels being formed at the support base and sequentially arranged in a height direction of the electric control box, and air outlets of at least two of the plurality of heat dissipation flow channels corresponding to the heat dissipation device;

wherein:

the plurality of heat dissipation flow channels include a first flow channel and a second flow channel, the first flow channel being located below the second flow channel in the height direction; and an air outlet and an air inlet are formed at two ends, respectively, of the first flow channel in an extending direction of the first flow channel, a sectional area of the first flow channel gradually increasing in a direction from the air inlet to the air outlet of the first flow channel.

* * * * *